US008408296B2

(12) United States Patent
Edwards

(10) Patent No.: US 8,408,296 B2
(45) Date of Patent: Apr. 2, 2013

(54) METHODS FOR BOREHOLE MEASUREMENTS OF FRACTURING PRESSURES

(75) Inventor: John E. Edwards, Medinat Al Alam (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 250 days.

(21) Appl. No.: 12/858,542

(22) Filed: Aug. 18, 2010

(65) Prior Publication Data

US 2012/0043077 A1 Feb. 23, 2012

(51) Int. Cl.
*E21B 49/00* (2006.01)

(52) U.S. Cl. ..... 166/250.1; 166/308.1

(58) Field of Classification Search ..... 166/250.1, 166/308.1, 100, 177.5
See application file for complete search history.

(56) References Cited

U.S. PATENT DOCUMENTS

| | | | | |
|---|---|---|---|---|
| 2,516,421 | A | 7/1950 | Robertson | |
| 3,530,933 | A | 9/1970 | Whitten | |
| 4,339,948 | A | 7/1982 | Hallmark | |
| 4,860,581 | A | 8/1989 | Zimmerman et al. | |
| 4,936,139 | A | 6/1990 | Zimmerman et al. | |
| 5,131,472 | A | 7/1992 | Dees et al. | |
| 5,195,588 | A | 3/1993 | Dave | |
| 5,233,866 | A | 8/1993 | Desbrandes | |
| 5,353,637 | A | 10/1994 | Plumb et al. | |
| 5,517,854 | A | 5/1996 | Plumb et al. | |
| 5,687,806 | A | 11/1997 | Sallwasser et al. | |
| 5,692,565 | A | 12/1997 | MacDougall et al. | |
| 5,746,279 | A | 5/1998 | Havlinek et al. | |
| 5,779,085 | A | 7/1998 | Havlinek et al. | |
| 6,119,782 | A | 9/2000 | Flores et al. | |
| 6,167,968 | B1 | 1/2001 | Allarie et al. | |
| 6,274,865 | B1 | 8/2001 | Schroer et al. | |
| 6,772,839 | B1 * | 8/2004 | Bond | 166/298 |
| 7,380,599 | B2 | 6/2008 | Fields et al. | |
| 7,484,563 | B2 | 2/2009 | Zazovsky et al. | |
| 7,614,294 | B2 | 11/2009 | Hegeman et al. | |
| 7,677,316 | B2 | 3/2010 | Butler et al. | |
| 7,703,517 | B2 | 4/2010 | Tarvin et al. | |
| 7,845,405 | B2 | 12/2010 | Villareal et al. | |
| 7,999,542 | B2 | 8/2011 | Ramamoorthy et al. | |
| 2003/0051876 | A1 | 3/2003 | Tolman et al. | |
| 2004/0069487 | A1 | 4/2004 | Cook et al. | |
| 2008/0066536 | A1 | 3/2008 | Goodwin et al. | |
| 2008/0135299 | A1 * | 6/2008 | Fields et al. | 175/58 |

(Continued)

FOREIGN PATENT DOCUMENTS

WO 2009065793 A1 5/2009

OTHER PUBLICATIONS

International Search Report and Written Opinion of PCT Application No. PCT/US2011/048262 dated Mar. 15, 2012.

(Continued)

*Primary Examiner* — William P Neuder
(74) *Attorney, Agent, or Firm* — Daryl R. Wright; Robin Nana; James Kurka

(57) ABSTRACT

There is provided a method of testing a subterranean formation for fracture condition, including the steps of creating a side bore into the wall of a well traversing the formation, sealing the wall around the side bore to provide a pressure seal between the side bore and the well, pressurizing the side bore beyond a pressure inducing formation fracture while maintaining the seal and monitoring the pressure to identify the fracture condition.

11 Claims, 5 Drawing Sheets

U.S. PATENT DOCUMENTS

| | | | | |
|---|---|---|---|---|
| 2009/0114385 | A1 | 5/2009 | Lumbye | |
| 2009/0250207 | A1 | 10/2009 | May | |
| 2009/0255669 | A1 | 10/2009 | Ayan et al. | |
| 2009/0318313 | A1 | 12/2009 | Ali et al. | |
| 2010/0084134 | A1 | 4/2010 | Tulissi et al. | |
| 2010/0155061 | A1 * | 6/2010 | Zazovsky et al. | 166/264 |
| 2012/0043078 | A1 | 2/2012 | Ziauddin et al. | |
| 2012/0043080 | A1 | 2/2012 | Edwards | |

OTHER PUBLICATIONS

International Search Report and Written Opinion of PCT Application No. PCT/US2011/048256 dated Mar. 15, 2012.

International Search Report and Written Opinion of PCT Application No. PCT/US2011/048253 dated Mar. 15, 2012.

Al-Harthy et al., "Options for High-Temperature Well Stimulation," Oilfield Review, 2008/2009, vol. 20(4): pp. 52-62.

Arora et al., "SPE 129069: Single-well In-situ Measurement of Residual Oil Saturation after an EOR Chemical Flood," SPE International, 2010: pp. 1-18.

Cherukupalli et al., "SPE 136767: Analysis and Flow Modeling of Single Well MicroPilot* to Evaluate the Performance of Chemical EOR Agents," SPE International, 2010: pp. 1-16.

Edwards et al., "SPE 141091: Single-well In-situ Measure of Oil Saturation Remaining in Carbonate after an EOR Chemical Flood," SPE International, 2011: pp. 1-12.

Kristensen et al., "IPTC 14507: Feasibility of an EOR MicroPilot for Low-Salinity Water Flooding," International Petroleum Technology Conference, Feb. 2012: pp. 1-14.

Lea et al., "Simulation of Sandstone Acidizing of a Damaged Perforation," SPE Production Engineering, May 1992: pp. 212-218.

Liu et al., "OSEA 8810: Effects of Perforation Flow Geometry on Evaluation of Perforation Flow Efficiency," 7th Offshore South East Asia Conference, Feb. 1988: pp. 322-330.

Martin et al., "SPE 135669: Best Practices for Candidate Selection, Design and Evaluation of Hydraulic Fracture Treatments," SPE International, 2010: pp. 1-13.

Prouvost et al., "Applications of REal-Time Matarix-Acidizing Evaluation Method," SPE Production Engineering, Nov. 1989: pp. 401-407.

Rae et al., "SPE 82260: Matarix Acid Stimulation—A Review of the State-of-the-Art," SPE International, 2003: pp. 1-11.

Ramamoorthy et al., "Introducing the Micropilot: Moving Rock Flooding Experiments Downhole," SPWLA 53rd Annual Logging Symposium, Jun. 2012: pp. 1-16.

Schechter et al., "Example 7.2 Production of Oil Through a Single Undamaged Perforation," Oil Well Stimulation, New Jersey: Prentice Hall, 1992: p. 223.

Soliman et al., "SPE 130043: Fracturing Design Aimed at Enhancing Fracture Complexity," SPE International, 2010: pp. 1-20.

* cited by examiner

METHODS FOR BOREHOLE MEASUREMENTS OF FRACTURING PRESSURES

FIELD OF THE INVENTION

The present invention is generally related to methods of measuring fracturing and re-opening pressures and stresses in a borehole traversing a subterranean reservoir.

BACKGROUND

In the co-owned U.S. Pat. Nos. 5,353,637 and 5,517,854 to R. A. Plumb and Y. S. Dave much of background relevant to the present invention is set out in great detail and incorporated herein for reference. In the patents, the need for an accurate measurement of formation breakdown and re-opening pressures is highlighted together with methods to derive further parameters from such measurements. Parameters derived from the pressure measurements include for example the magnitude and direction of maximum and minimum horizontal stresses.

As stated in the '637 patent, it is the precise knowledge of differences in stress magnitude that allows engineers to predict the type of fracture treatment that will assure containment in the reservoir beds. However, precise stress magnitude data are rarely obtained, particularly not in shales, which can be very tight. Instead it is commonly assumed that the least principal horizontal total stress in shales is greater than in adjacent reservoir rocks. The '637 patent describes the use of instrumented packers or pairs of packers with hydraulics to pressurize the packers or the volume between packers to measure the important parameters.

Another technical area in oil field technology usually considered as unrelated to the production stimulation as described above is the so-called formation sampling. Various techniques for performing formation evaluation (i.e., interrogating and analyzing the surrounding formation regions for the presence of oil and gas) in open, uncased boreholes have been described, for example, in U.S. Pat. Nos. 4,860,581 and 4,936,139, assigned to the assignee of the present invention. An example of this class of tools is Schlumberger's MDT™, a modular dynamic fluid testing tool. Such a tool may include at least one fluid sample bottle, a pump to extract the fluid from the formation or inject fluid into the formation, and a contact pad with a conduit to engage the wall of the borehole. When the device is positioned at a region of interest, the pad is pressed against the borehole wall, making a tight seal for the pumping operation to begin.

To enable the same sampling in cased boreholes, which are lined with a steel tube, sampling tools have been combined with perforating tools. Such cased hole formation sampling tools are described, for example, in the U.S. Pat. No. 7,380,599 to T. Fields et al. and further citing the U.S. Pat. Nos. 5,195,588; 5,692,565; 5,746,279; 5,779,085; 5,687,806; and 6,119,782, all of which are assigned to the assignee of the present invention. The '588 patent by Dave describes a downhole formation testing tool which can reseal a hole or perforation in a cased borehole wall. The '565 patent by MacDougall et al. describes a downhole tool with a single bit on a flexible shaft for drilling, sampling through, and subsequently sealing multiple holes of a cased borehole. The '279 patent by Havlinek et al. describes an apparatus and method for overcoming bit-life limitations by carrying multiple bits, each of which are employed to drill only one hole. The '806 patent by Salwasser et al. describes a technique for increasing the weight-on-bit delivered by the bit on the flexible shaft by using a hydraulic piston.

Another perforating technique is described in U.S. Pat. No. 6,167,968 assigned to Penetrators Canada. The '968 patent discloses a rather complex perforating system involving the use of a milling bit for drilling steel casing and a rock bit on a flexible shaft for drilling formation and cement.

U.S. Pat. No. 4,339,948 to Hallmark discloses an apparatus and methods for testing, then treating, then testing the same sealed off region of earth formation within a well bore. It employs a sealing pad arrangement carried by the well tool to seal the test region to permit flow of formation fluid from the region. A fluid sampling arrangement in the tool is adapted to receive a fluid sample through the sealing pad from the test region and a pressure detector is connected to sense and indicate the build up of pressure from the fluid sample. A treating mechanism in the tool injects a treating fluid such as a mud-cleaning acid into said sealed test region of earth formation. A second fluid sample is taken through the sealing pad while the buildup of pressure from the second fluid sample is indicated.

In U.S. Patent Application Publication 2009/0255669 tools and methods are described for injecting fluid into the formation surrounding wellbore for various purposes such measuring fluid saturations and other formation parameters.

Methods and tools for performing downhole fluid compatibility tests include obtaining an downhole fluid sample, mixing it with a test fluid, and detecting a reaction between the fluids are described in the co-owned U.S. Pat. No. 7,614,294 to P. Hegeman et al. The tool includes a plurality of fluid chambers, a reversible pump and one or more sensors capable of detecting a reaction between the fluids. The patent refers also to a downhole drilling tool for cased hole applications.

In the light of above known art it is seen as an object of the present invention to improve and extend methods of determining fracture pressures and stresses while reducing requirements for hydraulic and mechanic equipment such as packers.

SUMMARY OF INVENTION

Hence according to a first aspect of the invention there is provided a method of testing a subterranean formation for fracture condition, including the steps of creating a side bore into the wall of a well traversing the formation, sealing the wall around the side bore to provide a pressure seal between the side bore and the well, pressurizing the side bore beyond a pressure inducing formation fracture while maintaining the seal and monitoring the pressure to identify the fracture condition.

The side bore is preferably drilled in direction of the maximum horizontal stress, if this direction is prior knowledge.

The method is furthermore best applied to formations of low permeability, which are believed to confine the spread of a fracture to the desired directions. A formation is considered to be of low permeability if the permeability at the test location is less than 100 mD (millidarcy) or even less than 20 mD or 10 mD.

This invention allows evaluation of stimulation fluids at reservoir (downhole) conditions. The invention is particularly useful for testing and evaluating formations for a subsequent hydraulic fracturing operation.

The method enables fracturing opening and re-opening tests with minimal use of hydraulic fluids.

These and other aspects of the invention are described in greater detail below making reference to the following drawings.

DETAILED DESCRIPTION

Figure 1:
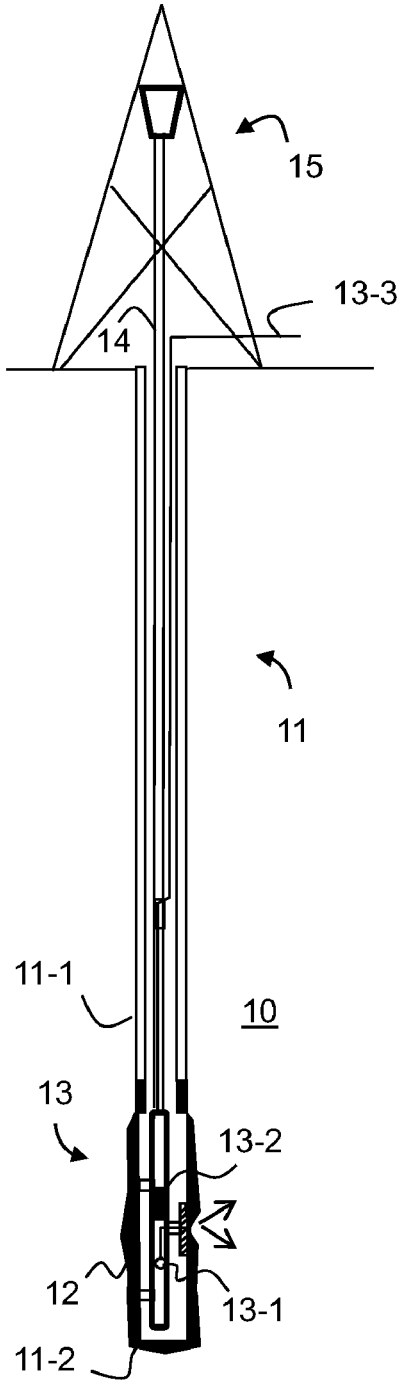
FIG. 1 shows a typically deployment of a formation drilling and sampling tool while performing steps in accordance with an example of the present invention.

In FIG. 1, a well 11 is shown drilled through a formation 10. The well 11 includes an upper cased section 11-1 and a lower openhole section 11-2. The lower openhole section is shown with a layer 12 of formation damaged and invaded through a prior drilling process which left residuals of the drilling fluids in the layer surrounding the well.

In this example of the invention, a wireline tool 13 is lowered into the well 11 mounted onto a string of drillpipe 14. The drill string 14 is suspended from the surface by means of a drilling rig 15. In the example as illustrated, the wireline tool includes a formation testing device 13-1 combined with a formation drilling device 13-2. Such tools are known per se and commonly used to collect reservoir fluid samples from cased sections of boreholes. The CHDT™ open hole drilling and testing tool as offered commercially by Schlumberger can be regarded as an example of such a tool. The connection to the surface is made using a wireline 13-3 partly guided along the drill string 14 (within the cased section 11-1 of the well 11) and partly within the drill string (in the open section 11-2).

The operation of this combined toolstring in a downhole operation in accordance with an example of the invention is illustrated schematically in the following FIGS. 2-3.

In the example, it is assumed that the stresses around the well 11 have been logged using standard methods such acoustic or sonic logging. At a target depth, the tool 13 is oriented such that it is aligned in directions of the maximum horizontal stress. It is in this direction that fractures typically open first when the whole well is pressurized in a normal fracturing operation. The mounted tool 13 can be rotated by rotating the drill string 14 and thus assume any desired orientation in the well 11.

Figure 2:
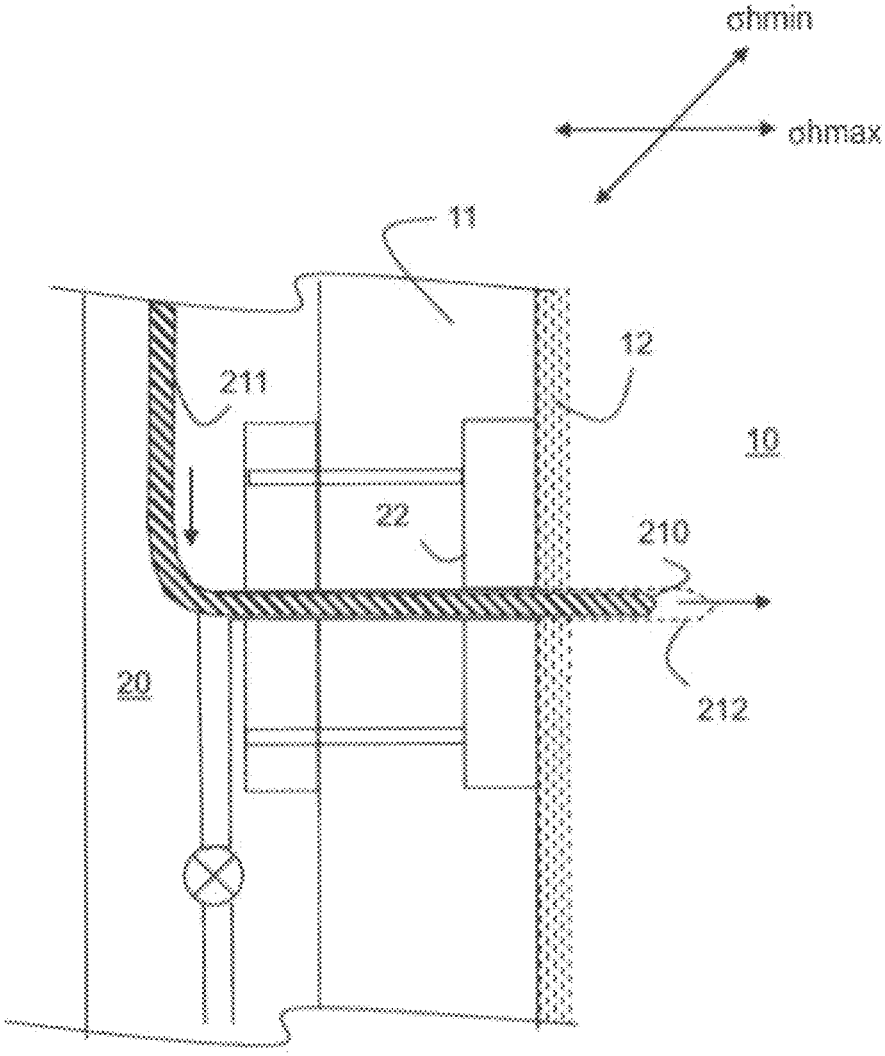
FIG. 2 illustrates the step of drilling a side bore to an existing well in accordance with an example of the present invention.

Making use of the conventional operation mode of the CHDT tool 13, the body 20 of the tool as shown in more detail in FIG. 2 includes a small formation drill bit 210 mounted on an internal flexible drill string 211. While the tool is kept stationary using the sealing pad 22 and counterbalancing arms (not shown), the flexible drill 210 can be used to drill a small side bore 212 into the formation 10 surrounding the well 11.

In the example, a 9 mm diameter hole 212 is drilled to an initial depth of 7.62 cm (3-in) before reaching the final depth of 15.24 cm (6-in). The drilling operation is monitored with real-time measurements of penetration, torque and weight on bit. The bit is automatically frequently tripped in and out of the hole to remove cuttings. The bit 210 trips can be manually repeated without drilling if a torque increase indicates a buildup of cuttings.

After the drilling of the side bore 212, reservoir fluids are produced to clean it of any cuttings that could adversely affect the subsequent injection. After the clean-out, the pressure in the side bore 212 is increased by pumping a (fracturing) fluid either from a reservoir with the tool or from within the well through the tool.

Figure 3A:
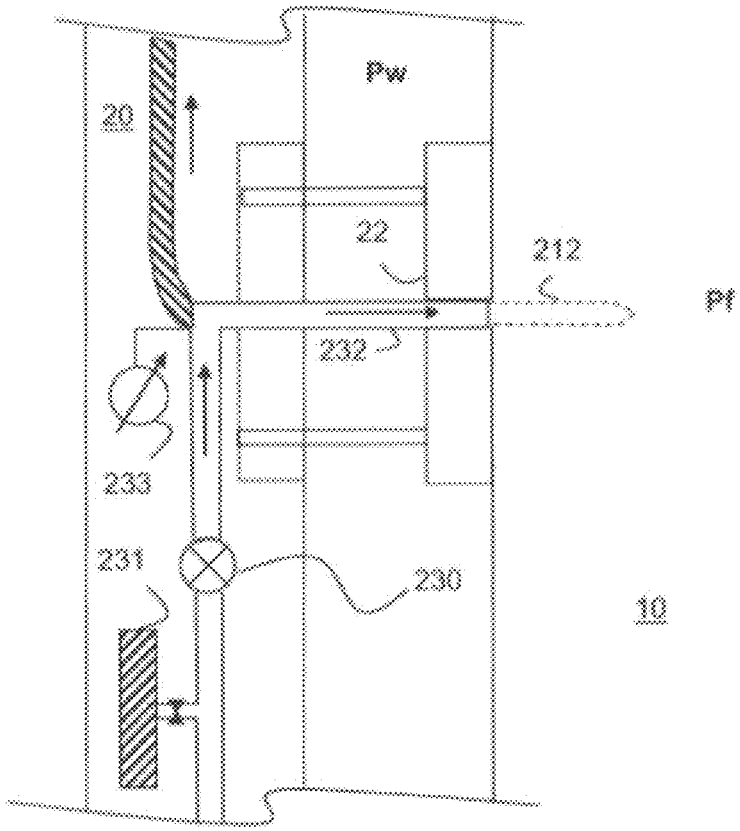
FIGS. 3A and 3B illustrate the step of fracturing the formation in the vicinity of a side bore in accordance with an example of the present invention.

As shown in FIG. 3A, the pump module 230, which is a positive displacement pump when using the CHDT tool, is activated in reverse after completing the clean-out of the side bore 212 and a fluid is injected from an internal reservoir 231 through an inner flow line 232 of the tool into the side bore 212. It is important for the present invention that the pad 22 maintains during the injection stages a seal between the well pressure Pw and the formation pressure Pf. The sealing pad in the present example seals an area of 7.3 cm by 4.5 cm. A pressure sensor 233 is used to monitor the pressure profile versus time during the operation. Any loss of seal can be noticed by comparing the pressure in the side bore with the well pressure Pw.

Figure 3B:
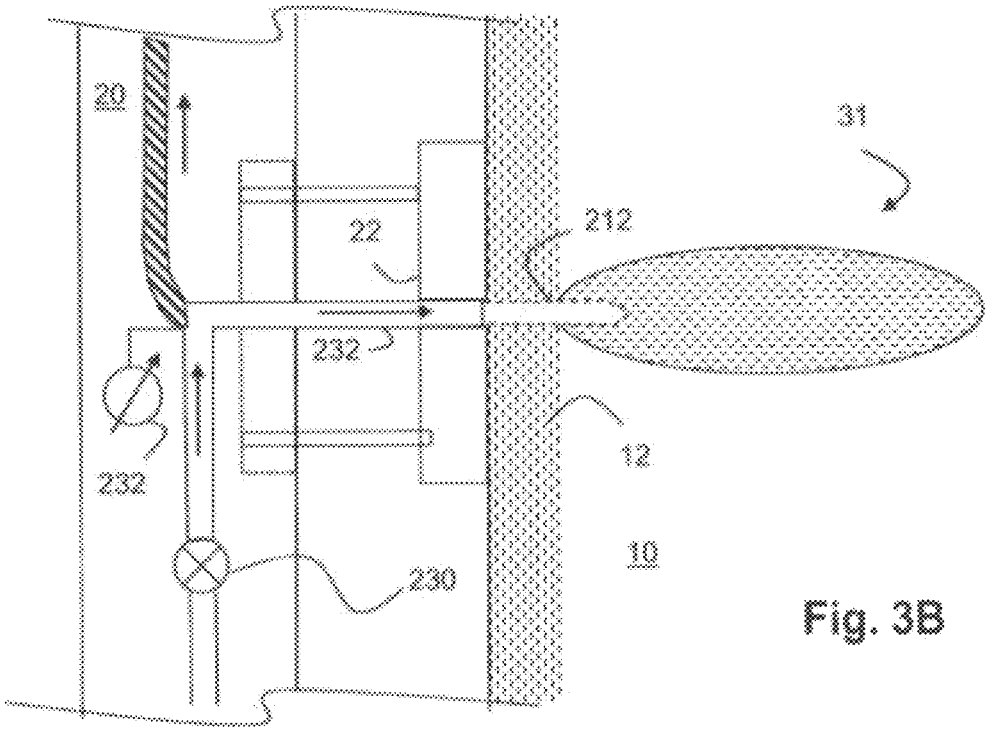

The injection pressure can be increased steps of for example 500 kPa increments, with pressure declines between each increment. Eventually the formation breakdown pressure is reached and a fracture 31 as shown in FIG. 3B develops at the location of the side bore 212. Typically the initial fracture pressure is the highest pressure shown in the curves of FIG. 3C, which illustrates an initial pressure test and subsequent reopening tests as detailed below.

In the carbonate formation of 1-10 mD of the example the fracture initiation pressure was established as 19080 kPa. From the first fall off after this fracture initiation the instantaneous fracture shut in pressure is 18700 kPa corresponding to the moment the pump is stopped, followed by the fracture closure pressure of 17920 kPa. At the point the fracture closes the pressure decay changes its characteristic. The pressure at fracture closure is known to be a measure of the minimum horizontal stress.

Figure 3C:
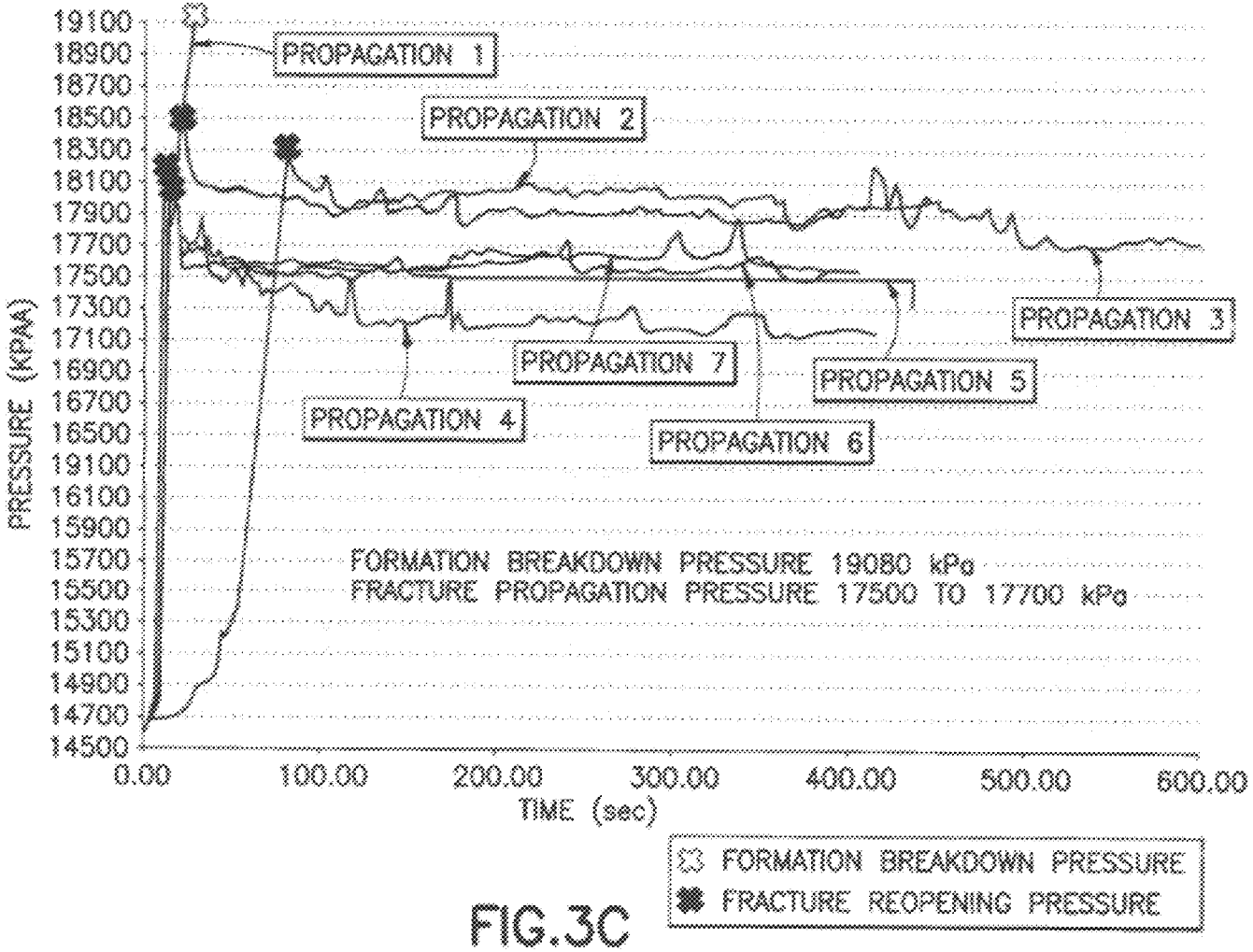
FIG. 3C reproduces pressure vs time profiles similar to those expected to be measured in accordance with an example of the present invention.

As shown in FIG. 3C, subsequent increases in the injection rate by increasing the hydraulic motor speed from 300 to 1800 rpm do not alter the injection pressure, which fluctuated around the fracture propagation pressure. This insensitivity to injection rate suggests fracture propagation is dominating with little matrix injection. Of the six injection cycles following the fracture initiation and as illustrated in the curves of FIG. 3C, the fracture propagation pressure from the last three of 17500 to 17700 kPa were the most consistent, indicating the micro fracture 31 reaches deep enough into the formation to see far field stress conditions, i.e. the formation parameters unperturbed by the drilling of the main well 11.

As the unperturbed stress are typically smaller than those dominant in the damaged zone 12 of the well 11, the measurement is more representative while easier to perform.

There are two natural properties of low permeability formation that have been drilled with high pressure drilling fluid that may favor the application of the above methods. The first is the high pressure gradients that will exist in low permeability rock when subjected to a pressure disturbance. This means the elevated pressure zone surrounding the side bore will not extend far into the formation until a considerable time has elapsed after applying the pressurization to this side bore. The small volume of rock that is pressurized will be covered by the sealing pad that also seals the side bore.

The second natural property is the existence of a stress cage or "supercharged" zone 12 around the original drilled wellbore as shown in FIG. 3B. This zone 12 is created by the hydraulic force of the drilling fluid that supports the original well. The stress cage 12 is an annular volume of elevated stress several wellbore radii thick that surrounds any hole drilled with fluid at a pressure greater than the fluid pressure within the formation itself. The side bore 212 will partially penetrate this stress cage 12. When the side bore is pressurized up to the breaking strength of the formation, the induced fracture 31 will most likely orientate itself away from this stress cage, propagating away from the main wellbore 11.

This effect is believed to contribute to the fracture not intersecting the main well bore. And in turn it means that the seal of the pad covering the side bore is sufficient for the type of pressurizing and fracturing operation described above without requiring the use of further packers and the like to isolate the main well from the fracturing pressure.

Figure 3D:
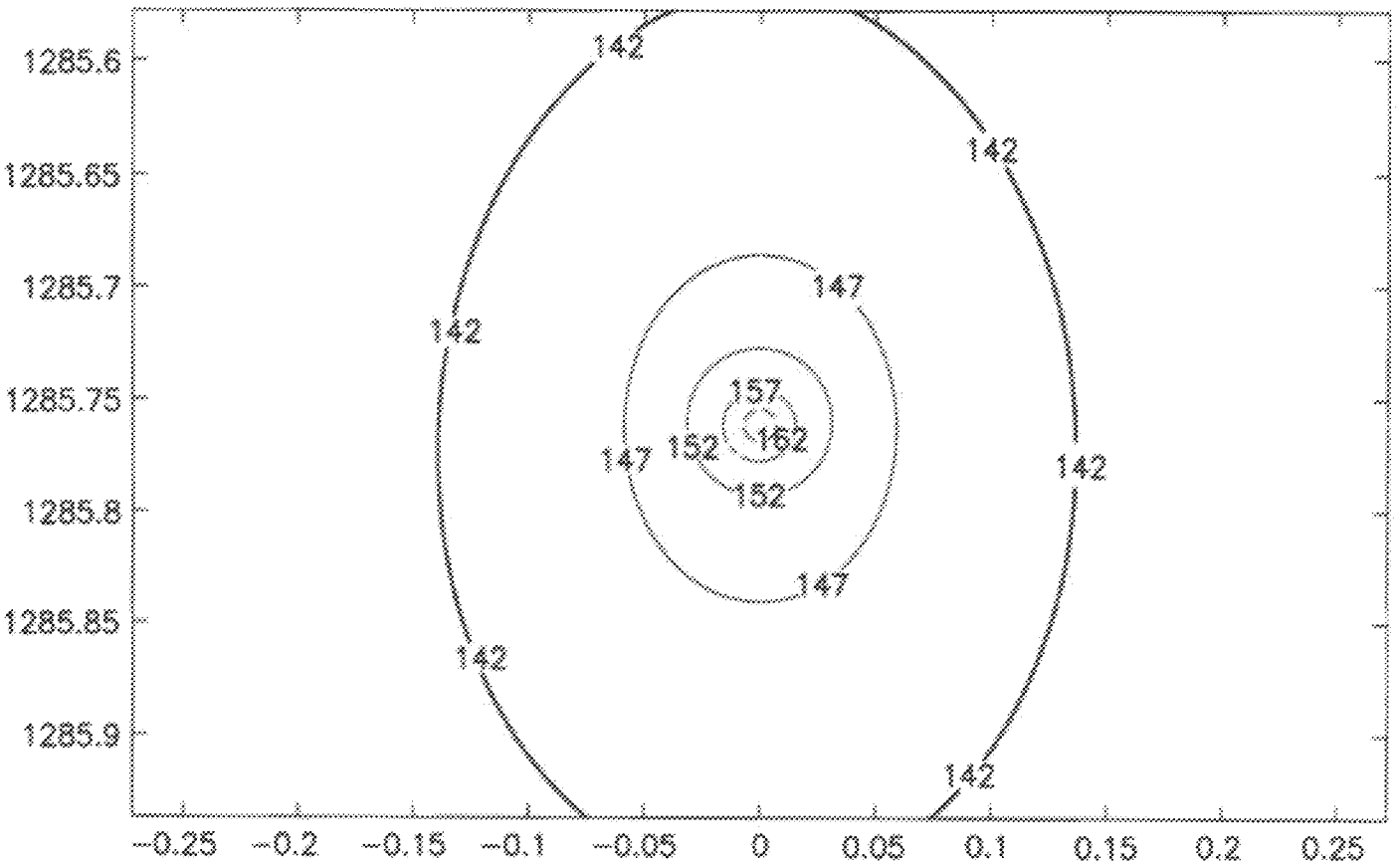
FIG. 3D are simulated contour plots around an injection point representing the approximate size of the high pressure zone at the well bore.

A simulation of the isobars around the injection point is shown in FIG. 3D. The contours shown are flattened, radial cross-sections of pressure at the wellbore wall for an injection rate of 1 cc/s. The vertical (depth) and horizontal distances are both measured in meters. The contours are drawn at successive multiples of 5 bars above initial reservoir pressure, which is 137 bars in the example. They show for example that the approximate diameter of the pressure-zone of 15 bar or more above reservoir pressure is 6 cm while for the zone of 20 bar or more above reservoir pressure it is 3 cm in agreement with the dimensions of the sealing pad used.

Using the various fracturing and fracture propagation and closing pressures as established by the present method, more parameters can be deduced as described in detail in the co-owned U.S. Pat. Nos. 5,353,637 and 5,517,854. However, it is worth noting that following the present method ensures that a fracture is only generated at one location of the well 11, whereas in known methods the fracture appears typically in the two equivalent directions of maximal horizontal stress. This change can be assigned to the inhomogeneous application of pressure in the well. Known methods as represented by the '637 and '854 patents generate a homogenous pressure along the circumference of the well. Following the present method, the pressure is confined to the location of the side bore.

By confining the pressure to single location and smaller volume a much smaller volume of fluid is required for the fracturing testing. Conventional fracturing tests on open hole formations with pairs of straddle packers generate fractures by pressurizing the much larger volume of the well between the two packers and create hence much larger fractures. With new method smaller volume of less than for example 100 liters or even less than 50 liters, appear sufficient to perform the tests. For most applications the volume of stored fracturing fluid can be chosen from the range of 5 to 20 liters. These small volumes enable the use of smaller high differential pumps which typically have a slow pump rate without extending the downhole test time. Furthermore dedicated and expensive fluids such as heavy liquids can be applied for testing in accordance with the present invention.

Moreover, while the preferred embodiments are described in connection with various illustrative processes, one skilled in the art will recognize that the system may be embodied using a variety of specific procedures and equipment. Accordingly, the invention should not be viewed as limited except by the scope of the appended claims.

What is claimed is:

1. A method of testing a subterranean formation for a fracture condition, comprising:

creating a side bore into a wall of a well traversing said formation;

sealing said wall around the side bore to provide a pressure seal between said side bore and said well;

pressurizing the side bore beyond a pressure inducing formation fracture while maintaining said seal; and monitoring the pressure to identify said fracture condition.

2. A method in accordance with claim 1, wherein the side bore is drilled in a direction of the maximum horizontal stress.

3. A method in accordance with claim 1, wherein the formation is uncased at the location of the side bore.

4. A method in accordance with claim 1, wherein the formation is a low permeability formation.

5. A method in accordance with claim 1, wherein the formation is a low permeability formation of less than 100 mD.

6. A method in accordance with claim 1, wherein pressurizing the side bore includes the step of pumping a fluid into said side bore.

7. A method in accordance with claim 6, wherein the volume of fluid is less than 50 liters.

8. A method in accordance with claim 6, wherein the volume of fluid is less than 20 liters.

9. A method in accordance with claim 1, wherein the step of pressurizing the side bore while maintaining said seal is repeated.

10. A method in accordance with claim 1, wherein the step of pressurizing the side bore while maintaining the seal is repeated to determine a fracture reopening pressure.

11. A method in accordance with claim 1, wherein the step of maintaining the seal while pressurizing the side bore is achieved solely by the pad surrounding the side bore without the use of further packers or similar mechanical sealing means.

* * * * *